US005178303A

United States Patent [19]

Blenkush et al.

[11] Patent Number: 5,178,303

[45] Date of Patent: Jan. 12, 1993

[54] DISPENSING VALVE APPARATUS

[75] Inventors: Brian J. Blenkush, Maple Grove; Blaine C. Sturn, Anoka, both of Minn.

[73] Assignee: Colder Products Company, Inc., St. Paul, Minn.

[21] Appl. No.: 702,598

[22] Filed: May 17, 1991

[51] Int. Cl.[5] ..... B65D 47/30; B67B 5/00; B67D 3/00

[52] U.S. Cl. ..... 222/153; 222/509; 222/559

[58] Field of Search ..... 222/153, 105, 509, 505, 222/559, 518, 564

[56] References Cited

U.S. PATENT DOCUMENTS

| | | | |
|---|---|---|---|
| 2,652,177 | 9/1953 | Lagemann | 222/509 |
| 2,751,130 | 6/1956 | Murphy | 222/509 |
| 3,333,300 | 8/1967 | Cohan . | |
| 3,481,000 | 12/1969 | Bärfuss . | |
| 3,584,834 | 6/1971 | Reid et al. | 222/518 X |
| 3,734,125 | 5/1973 | Bruce et al. | 222/509 X |
| 4,155,698 | 5/1979 | Aichinger . | |
| 4,452,425 | 6/1984 | Lucking | 222/518 X |
| 4,541,605 | 9/1985 | Kubota et al. . | |
| 4,664,297 | 5/1987 | Giovinazzi | 222/509 X |
| 4,664,421 | 5/1987 | Jones . | |
| 4,687,123 | 8/1987 | Hyde | 222/518 |
| 4,693,400 | 9/1987 | Frahm et al. | 222/153 X |
| 4,709,757 | 12/1987 | Bly . | |
| 4,731,014 | 3/1988 | Von Holdt . | |
| 4,844,301 | 7/1989 | Juillet | 222/509 |
| 4,848,600 | 7/1989 | Dark | 222/559 X |
| 5,033,777 | 7/1991 | Blenkush . | |

FOREIGN PATENT DOCUMENTS 2077377 12/1981 United Kingdom .

OTHER PUBLICATIONS

Exhibit A-2 photographs of a valve with a center operating tab.
Exhibit B-2 photographs of a coffee pot style valve.
Exhibit C-3 photographs of an extendable valve.
Exhibit D-2 photographs of a blue twist valve.
Exhibit E-4 photos of a black valve with central operating push mechanism.
Exhibit F-2 photos of a black twist valve with concentric twist member.

*Primary Examiner*—Kevin P. Shaver
*Attorney, Agent, or Firm*—Merchant, Gould, Smith, Edell, Welter & Schmidt

[57] ABSTRACT

A dispensing valve includes a body defining a passage with a first opening and a second opening. The body further has an outer surface with a lock surface and an open surface. A pluger is slidably disposed within the passage for movement between a first position wherein a fluid tight seal is formed between the plunger and the body for preventing fluid flow between the first opening and the second opening, and a second position wherein fluid flow is permitted between the first opening and the second opening. An arm extends from the plunger and includes a projection slidably engageable with the outer surface of the body. The arm includes biasing structure for biasing the projection against the outer surface of the body. The projection is engageable with the lock surface when the plunger is in the first position for maintaining the plunger in the first position. The projection is engageable with the open surface of the body when the plunger is in the second position for maintaining the plunger in the second position. Finger pads and finger grips are provided on the plunger and the body to operate the plunger between positions with a single hand of the operator.

36 Claims, 10 Drawing Sheets

DISPENSING VALVE APPARATUS

FIELD OF THE INVENTION

The present invention relates to dispensing valves. In particular, the present invention relates to dispensing valves useful in fluid dispensing systems having a bag containing fluid wherein the bag is placed in an interior of a box for handling and storage.

BACKGROUND OF THE INVENTION

Various dispensing valves or control valves have been used in the past in connection with fluid dispensing systems for controlling fluid flow. "Bag-in box" fluid dispensing systems in particular employ a bag containing fluid, a valve for dispensing fluid from the bag, and a box, with the bag being placed in an interior of the box for handling and storage purposes. To dispense fluid from the bag, the valve is exposed, typically by opening a portion of the box. The valve controls fluid flow from the bag. In some bag-in-box constructions, the bag is not filled through the valve, only emptied. Instead, the bag may be filled through a opening which is sealed off during installation and attachment of the valve to the bag.

Some concerns in the dispensing valve or control valve industry in general include reducing the costs of manufacturing the valve. A related concern is the ease of assembly and manufacture. In the past, some valves have employed intricate and complex parts. Other valves have numerous small parts. Some valves are unreliable in that the valves may leak or may be moved from the open to the closed position inadvertently. In addition, some valves are awkward to operate by hand.

With respect to the bag-in-box industry, there are several significant concerns relating to the dispensing valve. A major concern is minimizing the cost to manufacture the valves. Many bag-in-box systems are disposable, meaning that the bag with the dispensing valve is a disposable item. Another concern is reducing the profile of the valve. In some bag filling and valve attachment machines, the size of the dispensing valve is limited. Also, space limitations in the box may exist for the valve.

Other considerations in the bag-in-box industry, and possibly other fluid dispensing systems, relate to the operation of the valve. One concern is whether the valve requires the application of an external force or forces to maintain the valve in the open position. This concern relates to whether the valve is hands free in the open position. In some valves, the valve automatically moves to the closed position from the open position when the operator's hand or hands are removed. Another concern is the ease in which the valve may be moved from the open to the closed position, and from the closed position to the open position. In general, bag-in-box dispensing systems do not provide much support of the dispensing valve in relation to the bag. In some cases, the bag is fairly flexible and no external rigid support of the valve is provided. Some valves must be manipulated with two hands to move the valve between positions.

Other concerns include whether the valve contains a safety lock feature to prevent accidental opening of the valve from the closed position, such as may occur during handling or transport. A further concern with bag-in-box systems is the versatility of the valve to be used in either a manual system, wherein the user opens the valve to fill a container and then closes the valve for future use, and the systems approach, wherein the valve is connected to a fluid dispensing system with the fluid being pumped from the bag to a dispensing station having on/off controls. An additional concern, especially with inexpensive valves, is the reliability of remaining leak free in the closed position during operation. Some valves employ separate o-ring seals, which are prone to problems such as inconsistent performance overtime.

It is clear that there has existed a long and unfilled need in the prior art for a dispensing valve that addresses the above noted concerns in a cost effective and reliable manner.

SUMMARY OF THE INVENTION

The present invention relates to a dispensing valve having a body with a fluid passage through an interior of the body defining an inner surface connecting a first opening to a second opening. The inner surface includes a first sealing surface between the first opening and the second opening. The body further has an outer surface. A plunger is slidably positioned in the interior of the body for movement between a first position and a second position. A sealing surface on the plunger sealingly engages the sealing surface of the body to prevent fluid flow between the first opening and the second opening when the plunger is in the first position. Fluid flow is permitted between the first opening and the second opening when the plunger is in the second position. Structure projects from the plunger to engage the outer surface of the body to maintain the plunger in the first position and in the second position.

In the preferred embodiment, biasing structure is provided to bias the projection against the outer surface of the body. Preferably, the outer surface of the body includes a lock surface projecting generally transversely from the body and also transverse to the direction of movement of the plunger. The lock surface is engageable with the projection to prevent movement of the plunger from the first position to the second position when the projection is engaged with the lock surface. Preferably, the outer surface of the body also includes an open surface for frictionally engaging the projection to maintain the plunger in the second position when the projection is engaged with the open surface. In the preferred embodiment, the open surface diverges from the body in a direction to bias the plunger toward the second position when the projection is engaged with the open surface.

In the preferred embodiment, structure is also provided with the plunger to release the projection from engagement with the lock surface when opposing forces are applied generally transversely to the body to permit movement of the plunger from the first position to the second position. Preferably, movement of the plunger from the first position to the second position and the application of opposing transverse forces to overcome the biasing force is accomplished through single-handed operation by the operator of the valve.

In the preferred embodiment, a ramp surface is provided to connect the open surface to the lock surface wherein the projection is slidable along the outer surface of the body between the open surface and the lock surface. When opposing forces are applied longitudinally to the plunger and to the body, the plunger is permitted to move from the second position to the first position. Preferably, movement of the plunger from the second position to the first position is possible through single handed operation by the operator of the valve.

In the preferred embodiment, the plunger is slidably received by a plunger opening in the body in fluid communication with the fluid passage through the body. A second seal, preferably a partline free lip seal, is provided on the plunger to sealingly engage a second sealing surface of the body to seal the plunger opening from the fluid passage. Structure is also provided for limiting movement of the plunger away from the plunger opening once the plunger has been operatively positioned in the plunger opening.

The valve also preferably includes structure for attaching the valve to a container, such as a flexible bag or a rigid container containing fluid. The valve of the present invention may be used to dispense fluid from the container either manually or in combination with a fluid dispensing system wherein the valve is maintained continuously in the open position and fluid flow is controlled by additional structure in the dispensing system.

Preferably, the valve is a two-piece construction with the first piece being the body and the second piece being the plunger. Preferably each piece is made from resilient molded plastic.

DETAILED DESCRIPTION OF THE PREFERRED EMBODIMENTS

Figure 1:
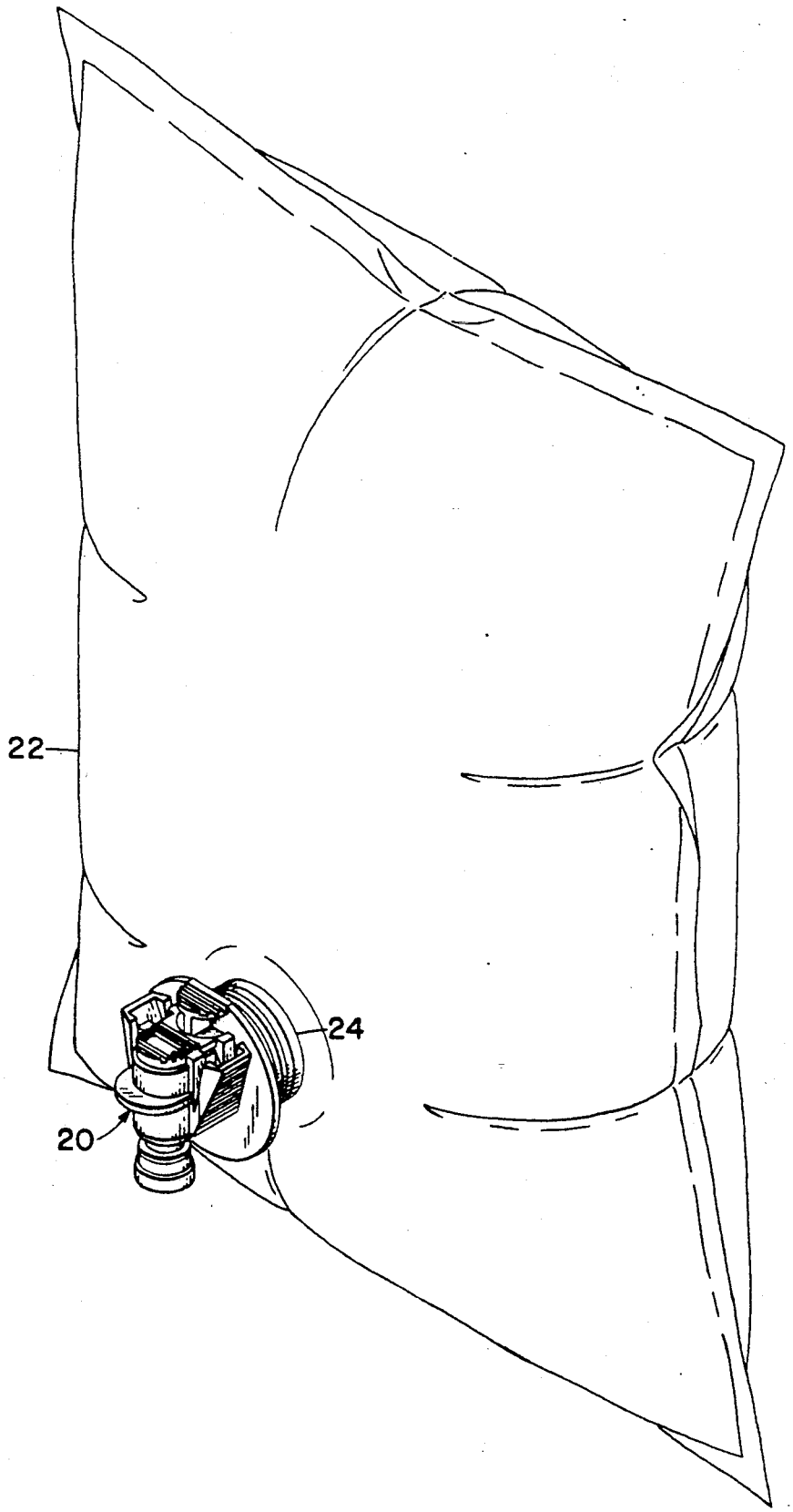
FIG. 1 is a perspective view of a bag for holding liquid and a dispensing valve for dispensing liquid from the bag.

Referring now to FIG. 1, a perspective view of a dispensing valve 20 attached to a bag 22 for holding fluid is shown. The bag 22 is preferably a flexible bag containing fluid. The dispensing valve 20 permits emptying of the fluid contained within the bag 22. A fitment 24 on the bag permits attachment of the dispensing valve 20 to the bag 22. The dispensing valve and bag arrangement shown in FIG. 1 is typical of a bag-in-box fluid dispensing system. In these systems, the bag 22 is filled with fluid, for example wine, and then placed in a box (not shown) for transport and storage. Typically, the box is opened partially to permit the valve 20 to extend out from the box to facilitate dispensing of fluid from the bag 22. With the valve 20 extending, the valve is operated to dispense fluid from the bag 22 through the valve 20. Typically, bag 22 with dispensing valve 20 is a disposable item that is thrown away once the fluid contained within bag 22 is emptied.

Figure 2:
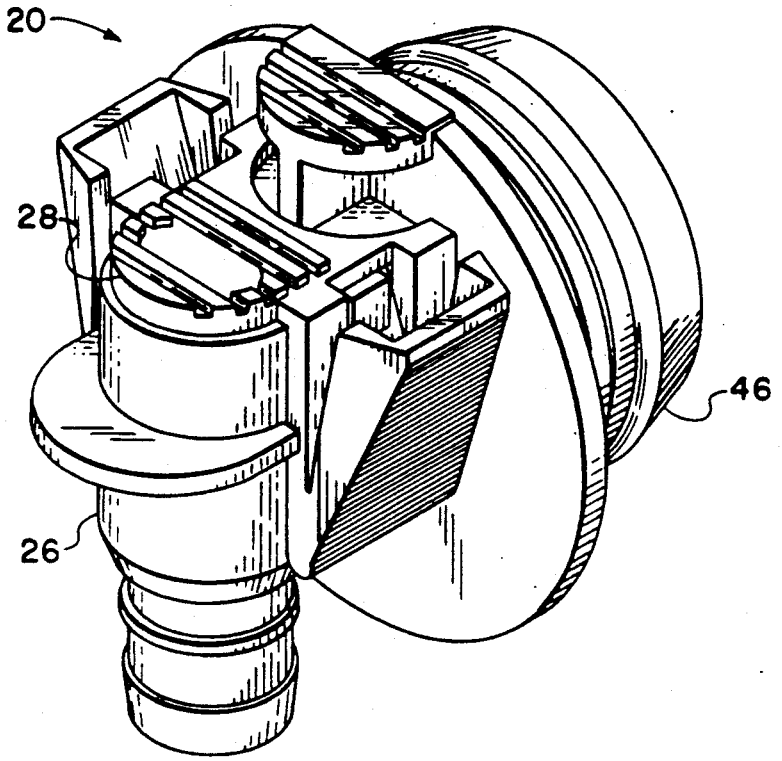
FIG. 2 is a perspective view of an embodiment of a dispensing valve according to the principles of the present invention showing the valve in the closed position.
Figure 3:
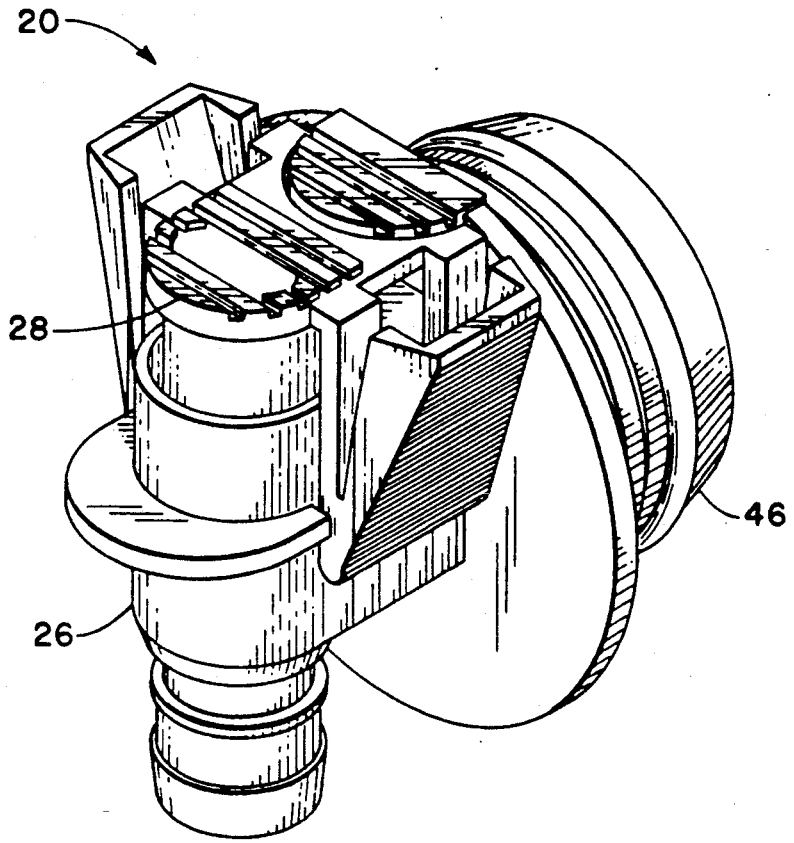
FIG. 3 is a perspective view of the dispensing valve of FIG. 2 showing the valve in the open position.
Figure 4:
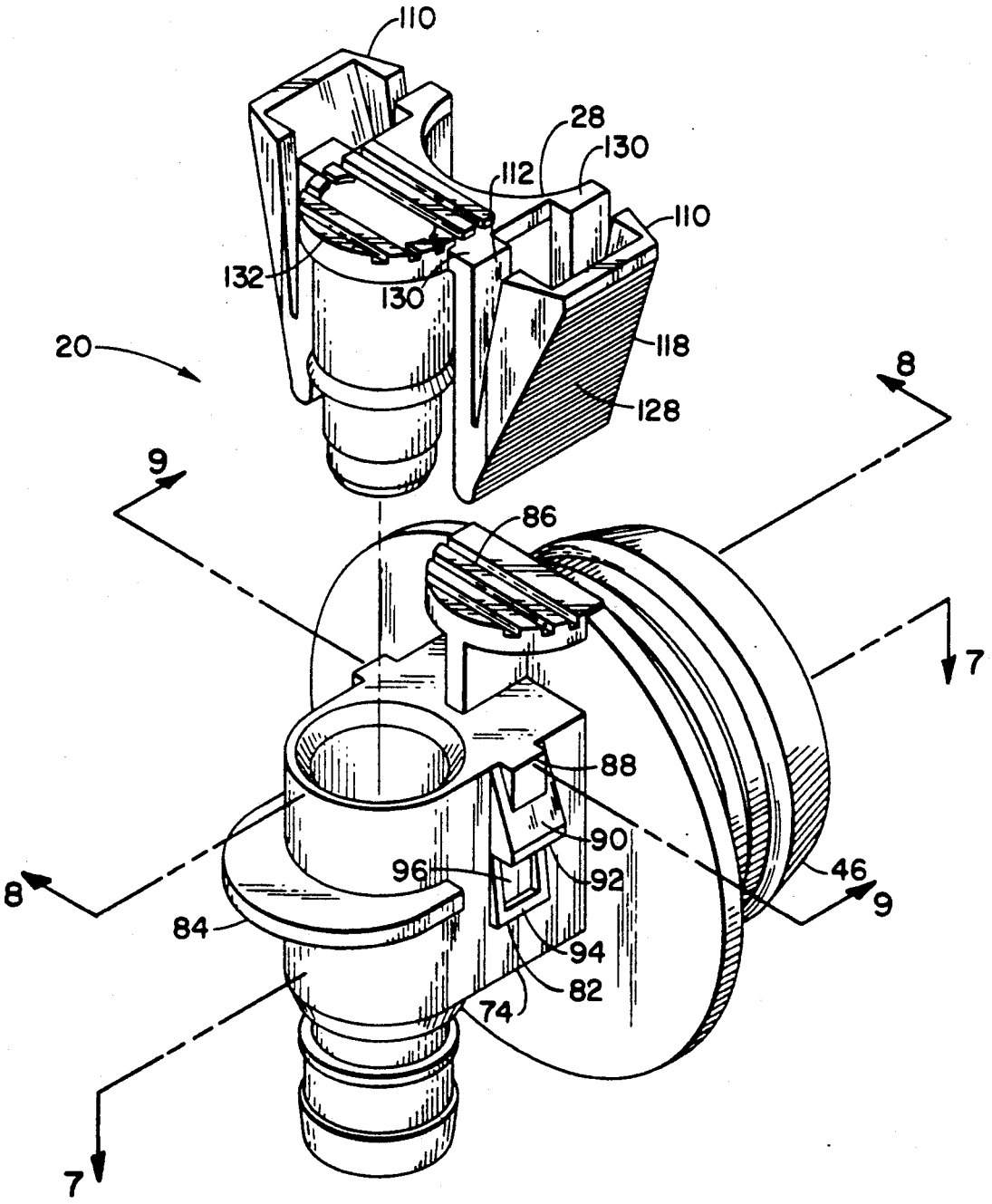
FIG. 4 is an exploded assembly perspective view of the valve shown in FIG. 2 showing the plunger separated from the body.
Figure 5:
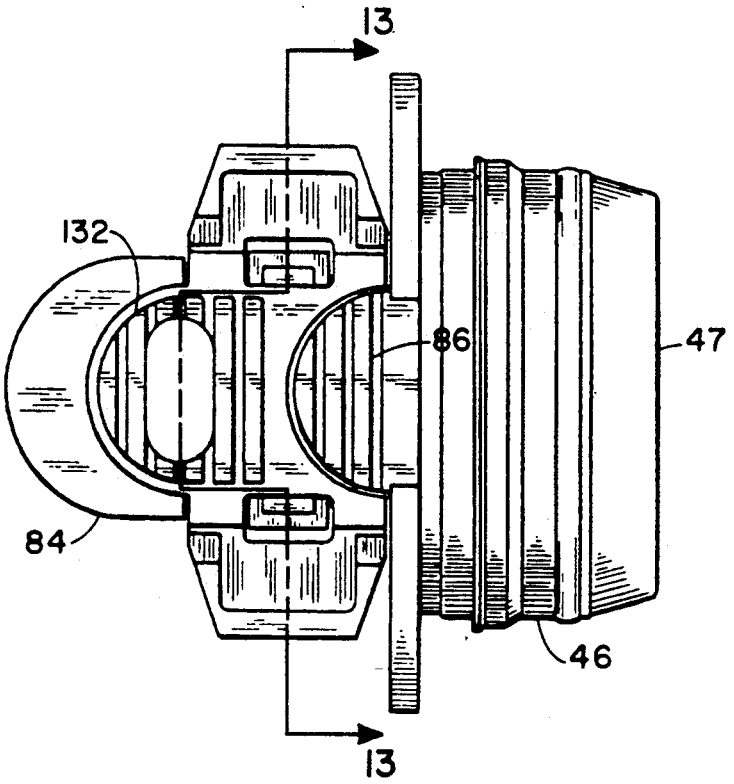
FIG. 5 is a top view of the valve shown in FIG. 2.

Referring now to FIGS. 2 and 3, the dispensing valve 20 is shown in greater detail. In FIG. 2, the dispensing valve 20 is shown in the closed or first position. In FIG. 3, the dispensing valve 20 is shown in the open position, or second position. In the preferred embodiment, dispensing valve 20 comprises two components which are preferably each integrally formed from resilient molded plastic. The first component is the body 26 which is attachable to the bag 22 through fitment mating portion 46. The second component of dispensing valve 20 is the plunger 28, which is slidably mounted to body 26. Referring now to FIG. 4, the dispensing valve 20 is shown in an exploded assembly view which helps makes clear the two-piece construction of the dispensing valve 20. By comparing FIGS. 2 and 3, it is apparent that plunger 28 is movable between a first position (down in the drawings) or closed position as shown in FIG. 2 and a second position (up in the drawings) or open position in FIG. 3. In the closed position, fluid flow through the valve 20 is not permitted. In the open position shown in FIG. 3, fluid flow is permitted through valve 20.

Figure 16:
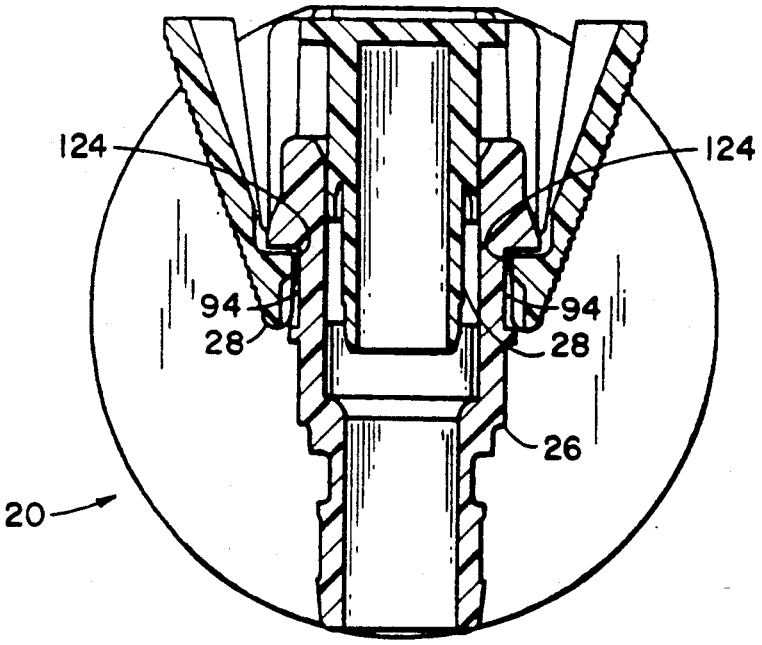

Referring now to FIGS. 5, 6, and 7-9, fluid flow is permitted through body 26 between first opening 47 and second opening 73 through fluid passage 75 when the plunger 28 is in the open position. FIG. 16 illustrates in cross-sectional view of the plunger 28 in the open position relative to the body 26. The fitment mating portion or fitment 46 of body 26 forms the first opening 47 and permits attachment of valve 20 to fitment 24 of bag 22. Fitment 46 can be any of a wide variety of different types of fitment structure for attaching valve 20 to bag 22. It is anticipated that snap-on fitments, threaded fitments and other styles of fitments are possible. The fitment 24 shown is a snap-on type fitment heat sealed to the bag 22. It is appreciated that fitment 46 of body 26 might instead include structure for attachment of valve 20 to a hose, such as with hose barbs, or other structure for attachment to various fluid couplings.

Fitment 46 of body 26 includes an cylindrical inner bore 48 which connects to passage 50 leading to opening 52. This region forms the entry passage of fluid from the bag into dispensing valve 20 in the preferred embodiment. Bore 54 extends completely through body 26 from a top end, or plunger end 58, to a bottom end 70. Bore 54 comprises a top bore 60 and a lower bore 72. Adjacent plunger end 58 is a plunger opening 55 for receiving a cylindrical portion 98 of the plunger 28 in the top bore 60, as will be discussed below. Bottom end 70 of the body 26 forms the second opening 73 of the valve 20. Bore 54 also defines a longitudinal axis 56 extending from the plunger end 58 to the bottom end 70. Top bore 60 of plunger end 58 defines a plunger passage 77 having a first sealing surface portion 62 and a second sealing surface portion 64.

Figure 8:
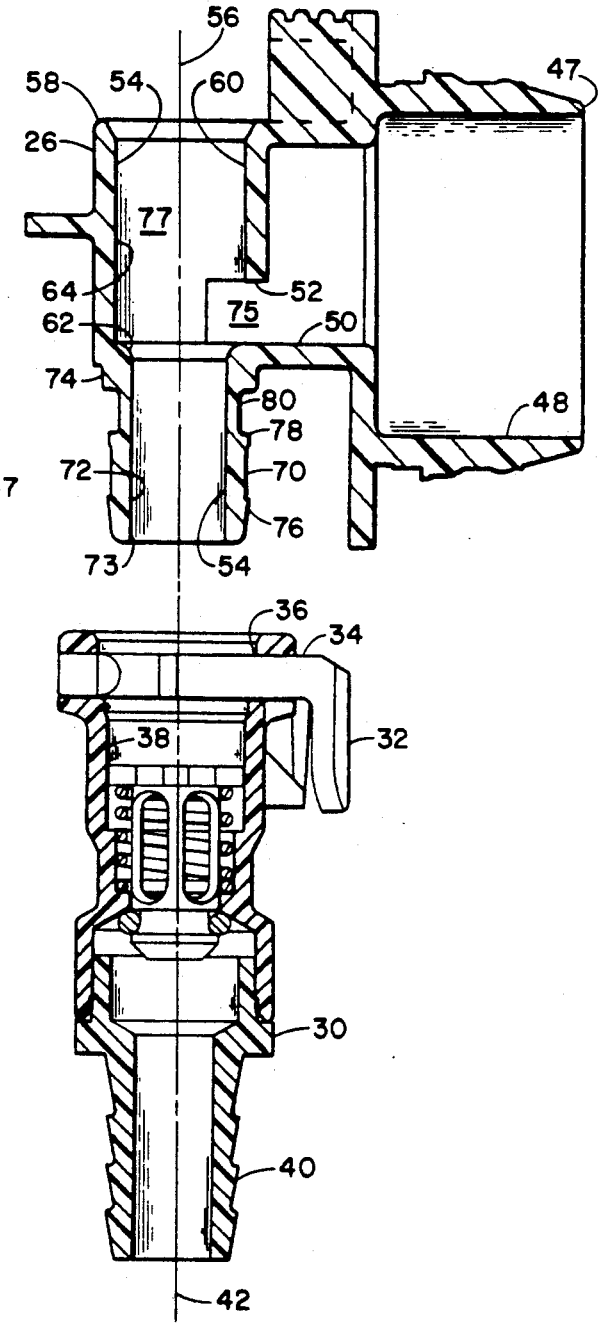
FIG. 8 is a cross-sectional side view of the body taken along lines 8—8 of FIG. 4 and also showing in partial cross-sectional view a female quick-connect coupling attachable to the body.

The bottom end 70 of the body 26 forms a male quick-connect coupling end in the preferred embodiment. Referring in particular to FIG. 8, a female quick-connect coupling 30 is shown separated from body 26 by dashed lines. Female quick-connect coupling 30 is representative of one type of coupling attachable to the body 26. Couplings may be attached to valve 20 for use in a systems dispensing arrangement. In a manual dispensing system, typically the valve would be manually opened and closed and fluid exited from valve 20 at the second opening 73 of valve 20 and dropped into a container to be filled with fluid. In the systems dispensing arrangement, the valve 20 is left continuously open to permit fluid flow from the first opening 47 of the valve 20 to the second opening 73 with the female coupling 30 or other coupling permitting attachment of a hose (not shown) to valve 20 for placement of bag 22 at a distance away from a dispensing station connected to the other end of the hose. Typically, the dispensing station has controls for controlling the emptying of the bag. Also, in a systems dispensing arrangement, a plurality of bags may be provided, with each bag possibly containing a different fluid. In some systems dispensing arrangements, multiple bags containing the same fluid may be connected together in the same fluid line such that the total fluid available for use without running out is the summation of the fluid contained in all of the bags connected together. This may benefit users in high volume settings since less frequent changing of bags is necessary.

As shown in FIG. 8, female quick-connect coupling 30 includes a latch mechanism 32 transversely slidable relative to a longitudinal axis 42 of the coupling 30. The latch mechanism 32 includes a latch plate 34. Coupling 30 also includes an inner bore 36 with a sealing surface 38 on one end of the coupling. On the opposite end of the coupling 30 are hose barbs 40 for attachment to a hose (not shown). The other end of coupling 30 is attachable to bottom end 70 of body 26. The longitudinal axis 42 of the female coupling 30 is alignable with the longitudinal axis 56 of bore 54 such that lower bore 72 of the body 26 is alignable with inner bore 36 of the coupling 30. The outer surface 74 adjacent the bottom end 70 of body 26 includes a seal 76, preferably partline free, for sealing against sealing surface 38 of coupling 30. Preferably, a second seal 78 is also present to provide additional sealing and support between the outer surface 74 and inner bore 36. Latch plate 34 has an opening therethrough for receiving the bottom end 70. A groove 80 receives an edge of latch plate 34 to lock female coupling 30 to the bottom end 70 of body 26.

It is to be appreciated that bottom end 70 could include any of a variety of different types of coupling structures. For example, bottom end 70 could include hose barbs for directly attaching bottom end 70 to a hose.

Figure 11:
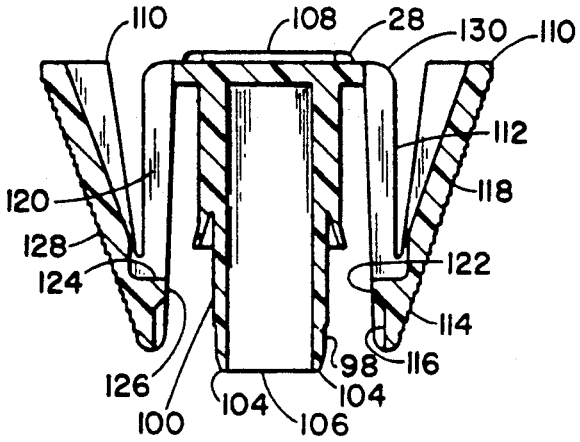
FIG. 11 is a cross-sectional front view of the plunger shown in FIG. 10 taken along lines 11—11.
Figure 12:
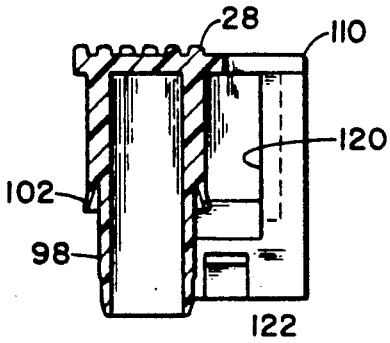
FIG. 12 is a cross-sectional side view of the plunger shown in FIG. 10 taken along lines 12—12.

As best shown in FIGS. 4, 11, and 12, the cylindrical portion 98 of plunger 28 includes an outer circumferentially surrounding surface 100. A first seal member 104, or plunger sealing surface, is located at a base 106 of the cylindrical portion 98. The seal member 104 is located at a tapered portion of base 106. The first seal member 104 is engageable with first sealing surface 62 of the body for sealing valve 20 between the first opening 47 and second opening 73 when the plunger is in the closed position. The cylindrical portion 98 of plunger 28 is slidably received in the plunger passage 77 through plunger opening 55 in the plunger end 58 of body 26. A second sealing surface or lip seal 102 on plunger 28 engages second sealing surface portion 64 of the body 26 to seal between the fluid passage 75 and the plunger opening 55. Preferably, lip seal 102 is a small flexible protrusion from plunger 28 that continuously seals against second sealing surface portion 64 when the plunger 28 is in the first position or the second position or in any positions in between. Plunger 28 is slidable in the direction of the longitudinal axis 56 to open and close valve 20.

Figure 18:
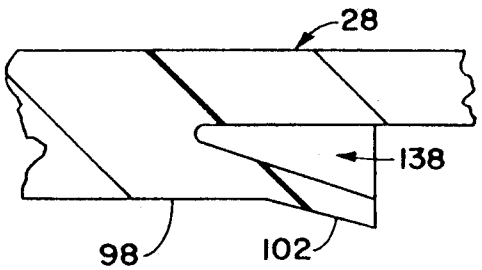
FIG. 18 is an enlarged cross-sectional view of a portion of plunger shown in FIG. 12 showing the structure of the lip seal in greater detail.

In the preferred embodiment, plunger 28 is a molded part. Preferably, lip seal 102 has a partline free sealing surface. FIG. 18 shows in greater detail the structure of the lip seal 102. Seal member 104 at tapered base 106 also preferably has a partline free sealing surface. If mold structures are used to make the plunger 28 which produce partlines on the sealing surfaces, unreliable parts may be produced. Problems in molding such as mold mismatch and flash may produce partlines on the sealing surfaces that could become leak points during use. By producing a plunger 28 with partline free sealing surfaces, problems of mold mismatch and flash can be avoided.

One molding technique to make lip seal 102 and seal member 104 partline free is to use two cylindrical mold members to form the cylindrical portion 98. The first mold member would be used to form the lower end of the cylindrical portion 98. The second mold member would be used to form the upper portion of the cylindrical portion 98. After the mold material forming plunger 28 has hardened, the first mold member is removed in a direction of the longitudinal axis. The second mold member is then moved axially, or "stripped off", with the second mold member forcing the lip seal 102 inward toward the plunger outer surface until the lip seal 102 clears the end of the second mold element. It is to be noted in FIG. 18 that lip seal 102 includes an undercut region 138 for receiving the lip seal when it is forced inward to remove the mold members. Lip seal 102 is then biased back to the position shown in FIG. 18.

In the preferred embodiment, structure is provided with valve 20 for maintaining valve 20 in the open position and in the closed position without having to apply external forces to maintain the valve in either state. Furthermore, in the preferred embodiment, structure is provided on valve 20 which permits single-handed operation of valve 20 between the open and closed positions and between the closed and the open positions. Structure is also provided to lock the valve in the closed position to prevent inadvertent opening of the valve 20. Structure is also preferably provided to prevent removal of the plunger 28 from the body 26 once inserted into the plunger opening 55.

Figure 9:
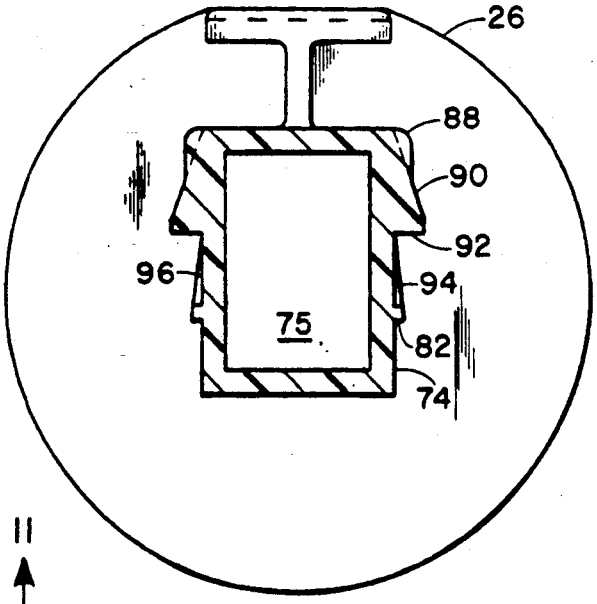
FIG. 9 is a cross-sectional front view of the body taken along lines 9—9 of FIG. 4.
Figure 10:
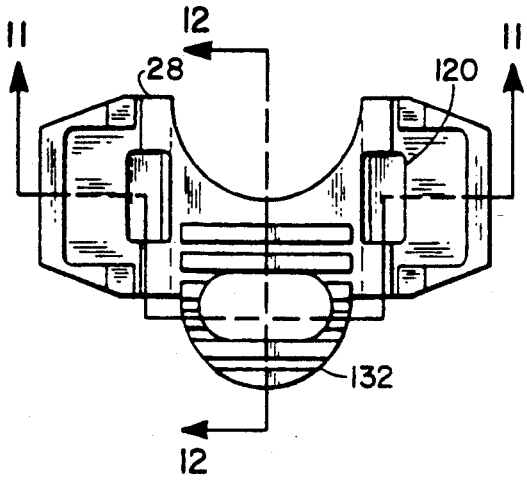
FIG. 10 is a top view of the plunger shown in FIG. 4.

As best shown in FIGS. 4 and 9, the body 26 includes a series of protrusions and surfaces located on outer surface 74 on opposite sides of the body adjacent the plunger end 58 for engagement with structure on the plunger 28 to permit the above-noted operation of valve 20. Beginning from top to bottom in the Figures noted, a protrusion 88 extends outward and is used for alignment purposes during assembly of valve 20. First ramp surface 90 is provided followed by stop 92. In the preferred embodiment, stop 92 includes a surface extending away from the body 26 generally transversely to longitudinal axis 56. Next in the downward direction is an open surface 94. In the preferred embodiment, open surface 94 has a U-shape with a cutout 96 to assist in proper molding of the product. Preferably open surface 94 diverges at an angle between zero and 90 degrees relative to the longitudinal axis 56 in a direction away from the body 26 toward the bottom end 70. Following open surface 94 is lock surface 82. In the preferred embodiment, lock surface 82 extends generally transversely to longitudinal axis 56 away from body 26.

The structure noted above along the sides of body 26 is engaged by a projection 122 on plunger 28 as will be discussed below in greater detail. As best shown in FIGS. 4, 10, 11, and 12, two arms 110 extend from the plunger adjacent the top 108 of the plunger 28. Arms 110 are positioned on opposite sides of the plunger 28 in the preferred embodiment. It is to be appreciated that in some embodiments, only one arm may be provided.

Each arm 110 comprises a first member 112 joined to the top 108 at connection point 130. Two connection points 130 are provided for each arm and are separated by a slot 120. Each arm also comprises a second member 118, with a bend 114 connecting the second member 118 to the first member 112.

Projection 122 is located adjacent bend 114 and engages the outer surface 74 of the body 26. Slot 120 on plunger 28 permits first member 112 to lie close to body 26 during operation wherein the projections on the body 26 are received by the slot 120 once the projection 122 passes over them. Projection 122 includes a top surface 124 and a side surface 126. Projection 122 also includes a notch 116 which is engageable with protrusion 88 to align the plunger 28 with the body 26 during assembly. During assembly, notch 116 receives protrusion 88 while the first seal member 104 of the plunger 28 initially engages plunger opening 55 in the body 26. This provides additional support to prevent damage to any of the seals from misalignment during assembly.

First member 112 resiliently biases projection 122 to the position shown in FIG. 11. During assembly, first ramp surface 90 pushes projection 122 against the biasing of first member 112 to permit sliding movement of the projection 122 past stop 92. Once past stop 92, the projection 122 is biased inward toward the body 26 by first member 112. Immediately below stop 92 is open surface 94. Preferably, projection 122 has the side surface 126 frictionally engaging the open surface 94 for maintaining the plunger 28 in the open position. In the preferred embodiment, the open surface 94 diverges away from the longitudinal axis 56 in a direction to bias the plunger 28 toward the second or open position. Because of the frictional engagement, and preferably biasing of the plunger to the second position, the valve 20 can be placed in the orientation shown in the Figures (open position with plunger up) with respect to the vertical such that gravity and possibly some vibrational movement of the valve 20 will not cause plunger 28 to move from the second position or open position to the first position or closed position.

If additional external opposing forces are applied to the body and to the plunger in the direction of the longitudinal axis, projection 122 will slide relative to body 26 on ramp 97 such that projection 122 slides past lock surface 82. Preferably, projection 122 includes the top surface 124 engageable with the lock surface 82 to prevent movement of the plunger from the closed position to the open position unless projection 122 is sufficiently pulled away from engagement with outer surface 74 the body past the outmost extension of lock surface 82 from the body 26. Preferably, the lock surface 82 is generally transverse to the longitudinal axis 56.

To operate valve 20, each arm 110 is provided with an open finger pad 128 as part of second member 118. The body 26 is provided with an open finger support 86. The two open finger pads 128 and the open finger support 86 can be used in a way to provide single-handed opening of a valve 20. For subsequently closing valve 20, a close finger pad 132 is provided on plunger 28. A close finger grip 84 is provided on body 26. The close finger pad 132 and the close finger grip 84 can be used in a manner that permits single-handed closing of the valve 20.

For operation of the valve 20, it is to be appreciated that in the description the word "finger" can be any digit of the hand. Preferably, the valve 20 is designed to be used with specific fingers. Operation of the preferred embodiment will be described with reference to the preferred fingers of the hand to be used. It is to be appreciated that two-handed operation is also possible instead of single-handed operation. Referring now to FIGS. 13–16, operation of valve 20 will be discussed in greater detail emphasizing how the open finger pad 128 and the open finger support 86 are used to open the valve 20 and how the close finger grip 84 and the close finger pad 132 are used to close the valve.

Figure 13:
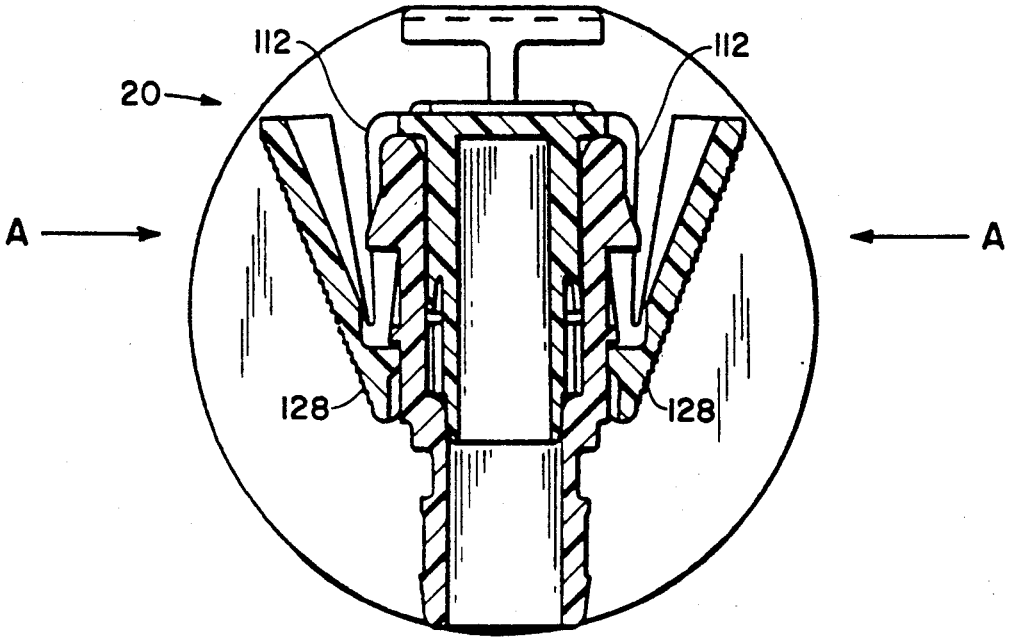
FIGS. 13-16 are cross-sectional front views of the valve shown in FIG. 5 taken along lines 13-13 showing the valve during various stages of operation.
Figure 14:
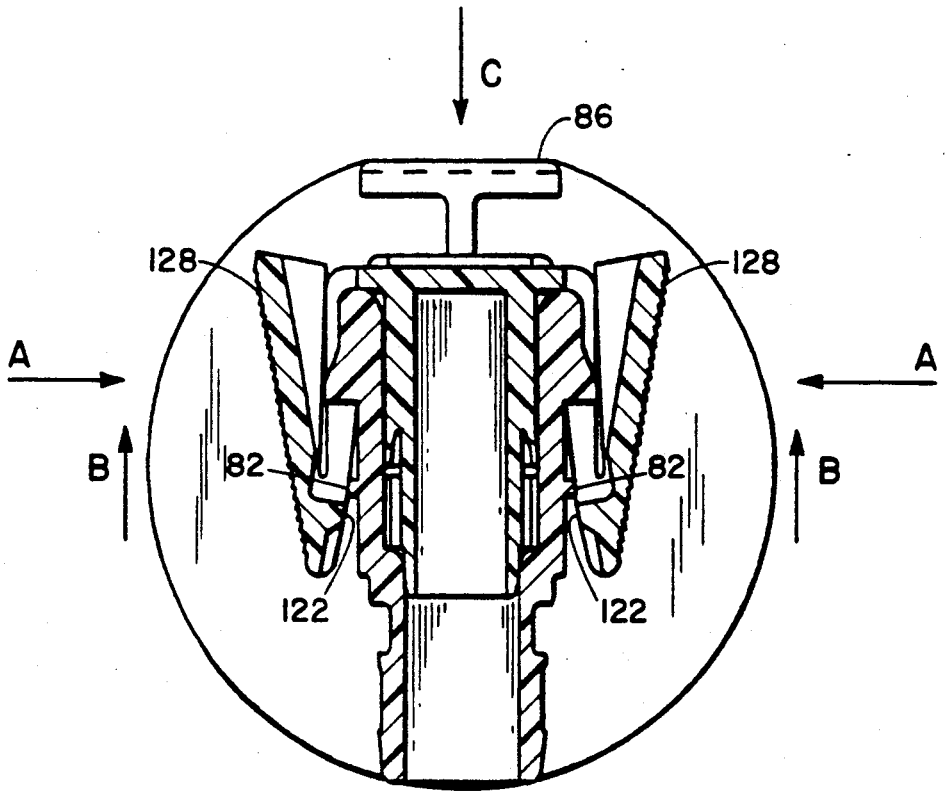

FIG. 13 represents valve 20 in the closed position. If opposing forces are applied to the open finger pads 128 in the direction of arrows A shown in FIG. 13, biasing by first members 112 is overcome to move projections 122 away from the outermost extension of lock surfaces 82 to the position shown in FIG. 14. The valve 20 is designed such that the thumb and second finger (next to the first finger, or index finger) can be used to apply the opposing forces which are transverse to and toward the longitudinal axis 56.

Figure 15:
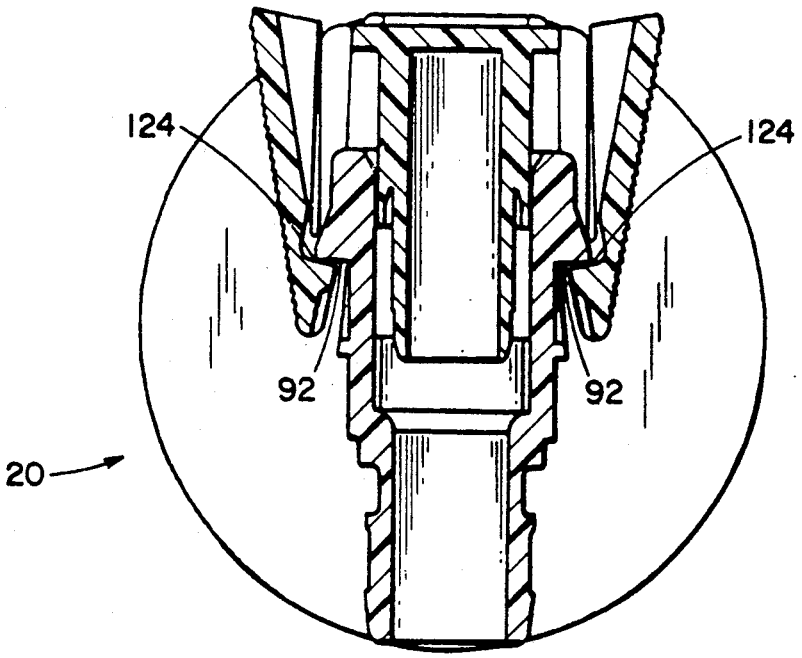

Referring again to FIG. 14, if the transverse forces are continually applied in the direction of arrows A by the thumb and second finger, and then the thumb and second finger apply a force to the finger pads 128 in a direction of the longitudinal axis 56 toward the plunger end 58 of the valve 20, represented by arrows B, and a downward longitudinal force is applied in the direction of arrow C by the first finger of the same hand on the open finger support 86, the plunger 28 will move in the longitudinal direction upward relative to body 26 as best shown in FIG. 15. As will be noted in FIG. 15, stop 92 on each side of body 26 engages top surface 124 of each projection 122 to stop the plunger 28 from any further movement upward relative to the body 26.

If all the forces are released, the plunger will bias the projections 122 into engagement with open surfaces 94 as is shown in FIG. 16. In the open position, the open surfaces 94 are engageable with the side surfaces 126 of the projections 122. In FIG. 16, the valve 20 is in the open position and is maintained in that open position hands free.

Figure 6:
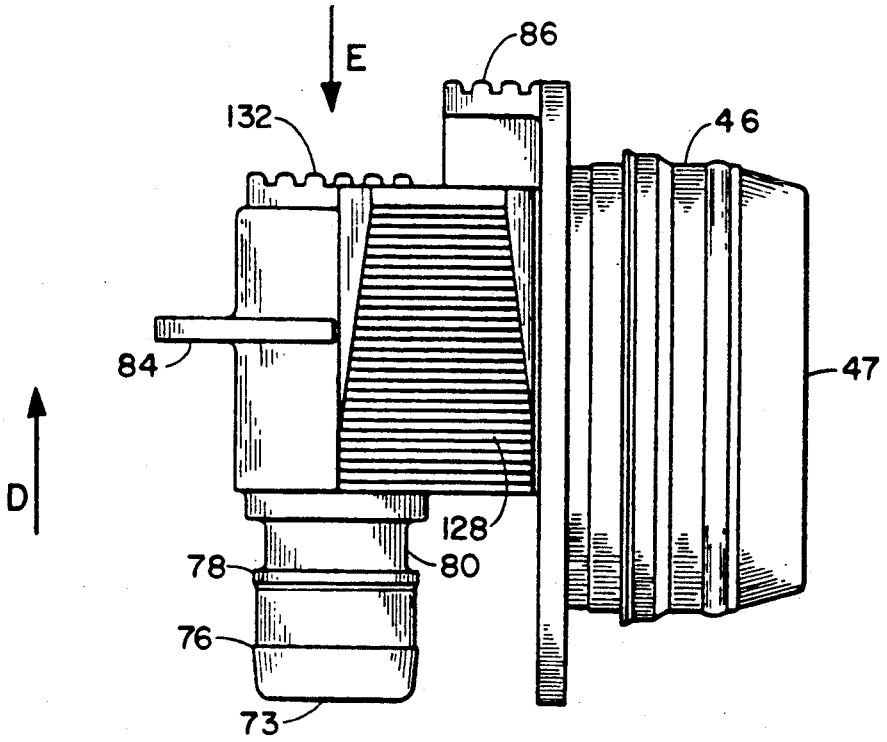
FIG. 6 is a side view of the valve shown in FIG. 2.
Figure 7:
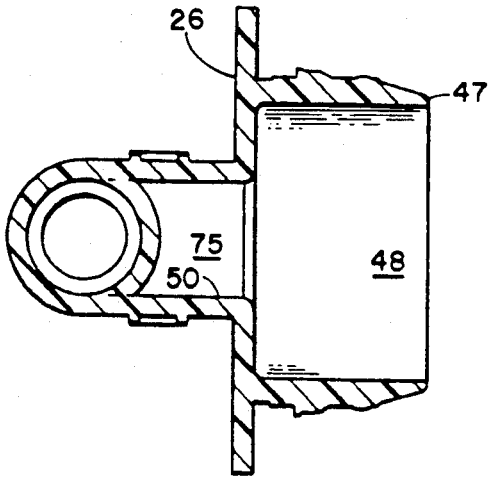
FIG. 7 is a cross-sectional top view of the body taken along lines 7—7 of FIG. 4.

Moving the valve 20 from the open position shown in FIG. 16 to the closed position shown in FIG. 13 can be accomplished in a variety of manners. In the preferred embodiment, valve 20 is operable in a single-handed manner. By placing an operator's thumb on close finger pad 132 and applying a force in the direction represented by arrow E in FIG. 6, and a first finger under close finger grip 84 on body 26 and applying a force in a direction of arrow D, plunger 28 will move to the closed position. Arrows D and E are shown in FIG. 6 with the valve 20 shown in the closed position. Single-handed closing is possible because ramp surface 97 permits sliding movement of the projections 122 from the open surfaces 94 past the edges of lock surfaces 82 such that the projections 122 are biased inward past the edge of lock surface 82. In the closed position, the lock surface 82 is engageable with the top surfaces 124 of the projections 122 to prevent movement to the open position absent the application of forces applied the open finger pads 128.

As best shown in FIG. 13, when the plunger 28 is in the closed position, the plunger 28 or any of the other parts of valve 20 extend beyond the outer periphery of plate 144. Outer periphery of plate 144 corresponds closely to the outer perimeters defined by the fitment 24 used to connect the valve 20 to the bag 22. During manufacture, the valve 20 and the fitment 24 may be handled as a unit during attachment of the fitment 24 to the bag 22. One process anticipated is heat sealing. After the fitment is heat sealed or otherwise attached to the bag 22, the valve 20 is removed to permit filling of the bag. Once filled, the valve is attached to the fitment. Fitment 24 is one type of conventional fitment structure for attaching a valve to a bag. Because the valve 20 does not define a profile larger than the fitment 24, the valve may be easily handled with the fitment by existing automated attachment machines during the attachment phase of manufacture.

Figure 17:
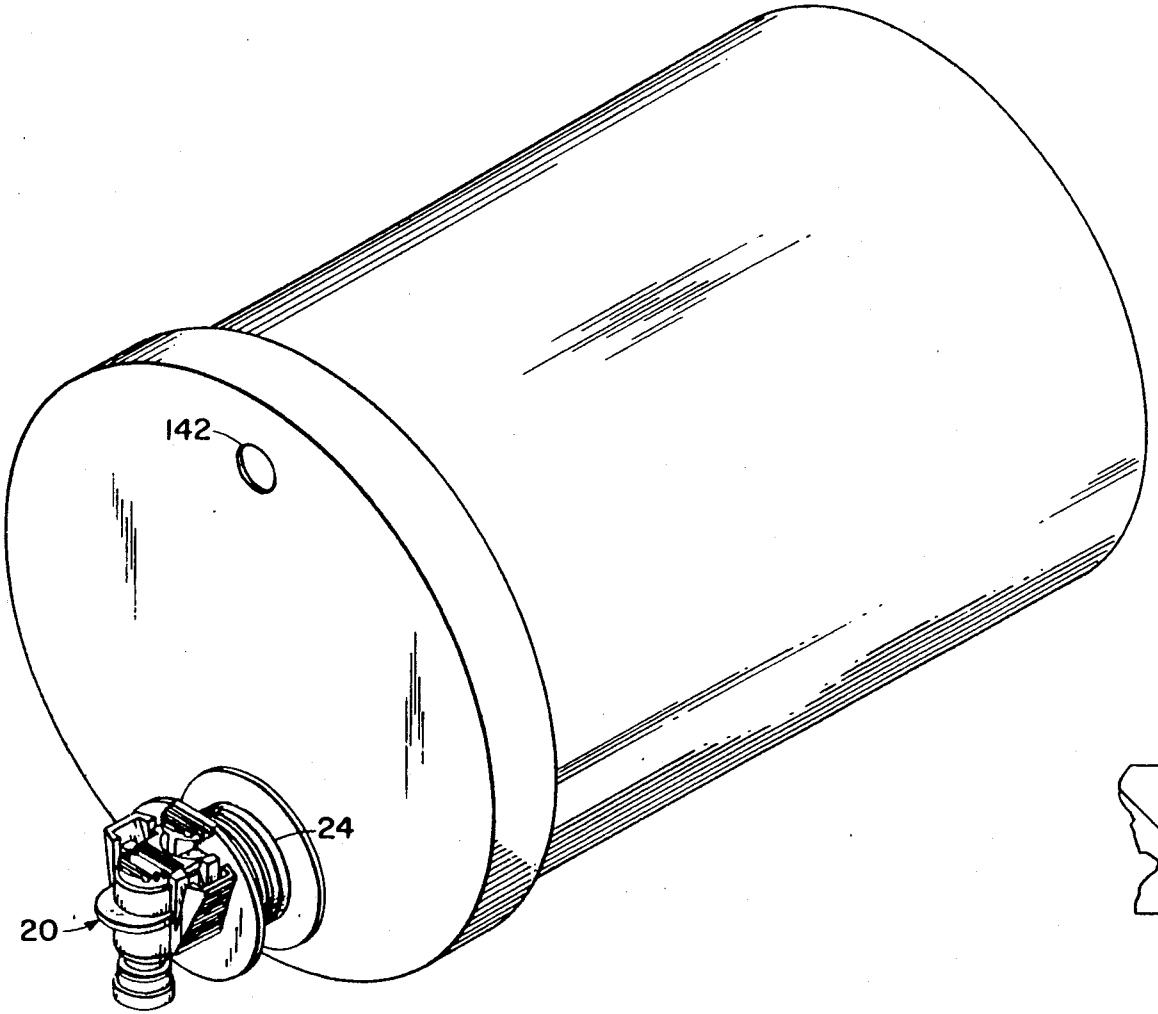
FIG. 17 is a perspective view of a vented rigid container for holding liquid with the dispensing valve provided for dispensing liquid from the container.

FIG. 17 illustrates another use of valve 20. In FIG. 17, a rigid container 140 for holding fluid is provided with the dispensing valve 20 attached to fitment 24. A vent 142 is provided to facilitate emptying of the container by permitting air to enter as fluid is evacuated from the container. With flexible bags and containers, no vents are needed since the bags will become smaller as fluid is evacuated from the bag.

It is to be appreciated that body 26 and plunger 28 can be made from a variety of materials. One material anticipated for body 26 is low density polyethylene. An anticipated material for plunger 28 is polypropylene. It is believed that these materials permit low-cost manufacturing, while providing reliable parts. Further, these material provide the appropriate resiliency of the parts such as arms 110 and lip seal 102. In addition, these materials provide the appropriate lubricity between lip seal 102 and second sealing surface 64. Preferably, the sliding friction between the lip seal 102 and sealing surface 64 is such that in a systems dispensing arrangement, the pump for emptying the bag is capable of producing sufficient vacuum when the bag has been completely evacuated that the valve will close automatically. The valve could be connected to a switch mechanism at a remote location for indicating that the bag is emptied.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A dispensing valve comprising:

a body having an inner surface defining a fluid passage through the body, the body further having an outer surface;

a plunger positioned in the fluid passage for slidable movement in a direction of a longitudinal axis of the valve, the plunger including seal means for sealing the fluid passage from fluid flow when the plunger is in a closed position, the seal means permitting fluid flow when the plunger is in an open position;

a resilient arm connected to the plunger and biased into locking engagement with locking means of the outer surface of the body when the plunger is in the closed position, the arm being manually disengageable from the body upon application of a transverse force generally toward the body so that the plunger can be moved longitudinally into the open position; and locking means associated with the outer surface of the body for selectively locking the resilient arm when the plunger is in the closed position.

2. The dispensing valve of claim 1, further comprising a second arm substantially similar to the first arm, wherein the first arm and the second arm are symmetrically positioned about the longitudinal axis.

3. The dispensing valve of claim 1, wherein the biased arm is a biased into engagement with the outer surface of the body when the plunger is in the open position to maintain the plunger in the open position.

4. A dispensing valve comprising:

a body defining a passage with a first opening and a second opening, the body further having an outer surface with a first surface portion and a second surface portion;

seal means including a plunger mounted for sliding movement in the passage of the body, the seal means forming a fluid tight seal in the passage between the first opening and the second opening in a first position, the seal means permitting fluid flow between the first opening and the second opening through the passage in a second position; and projection means connected to the seal means for selectively engaging the first surface portion and the second surface portion of the outer surface of the body, the projection means engaging the first surface portion to maintain the seal means in the first position, the projection means engaging the second surface portion to maintain the seal means in the second position, the projection means being moveable along the outer surface of the body in the same direction of movement as the seal means during movement of the seal means between the first and second positions.

5. The dispensing valve of claim 4, further comprising biasing means for biasing the projection means into engagement with the first surface portion of the outer surface of the body when the seal-means is in the first position and for biasing the projection means into engagement with the second surface portion of the outer surface of the body when the seal means is in the second position.

6. The dispensing valve of claim 5, wherein the passage has a portion defining a longitudinal axis, and the seal means being slidable in a direction along the longitudinal axis to move between the first position and the second position.

7. The dispensing valve of claim 6, wherein the first surface of the outer surface of the body ,extends from the body in a direction generally transverse to the longitudinal axis, the projection means including a portion engageable with the first surface of the body to lock the seal means from movement from the first position to the second position.

8. The dispensing valve of claim 6, wherein the second surface of the body diverges from the body in a direction away from the longitudinal axis at an angle greater than zero and less than 90 degrees, the projection means including a portion slidably engageable with the second surface, the second surface forming a ramp surface biasing the seal means toward the second position when the projection means is biased against the second surface.

9. The dispensing valve of claim 7, wherein the second surface of the outer surface of the body is continuous with the first surface, and wherein movement of the seal means from the second position to the first position moves the projection means from engagement with the second surface to engagement with the first surface.

10. The dispensing valve of claim 4, wherein the second surface of the outer surface of the body and the projection means frictionally engage when the seal means is in the second position to maintain the seal means in the second position.

11. A dispensing valve comprising:

a body having a passage through the body defining an inner surface connecting a first opening to a second opening, the inner surface including a sealing surface between the first opening and the second opening, the passage having a portion defining a longitudinal axis, the body further including an outer surface;

a plunger slidably positioned in the passage for movement along the longitudinal axis, the plunger having a sealing surface, the plunger positionable in a first position wherein the sealing surface of the plunger and the sealing surface of the body engage to form a fluid tight seal in the passage between the first opening and the second opening, the plunger positionable in a second position wherein fluid flow is permitted between the first opening and the second opening through the passage;

an arm extending from the plunger, the arm including a projection slidably engageable with the outer surface of the body, the arm including biasing means for biasing the projection against the outer surface of the body;

the outer surface of the body including lock surface means engageable with the projection when the plunger is in the first position for maintaining the plunger in the first position; and the outer surface of the body further including open surface means engageable with the projection when the plunger is in the second position for maintaining the plunger in the second position.

12. The dispensing valve of claim 11, wherein the lock surface means includes a lock surface extending generally transverse to the longitudinal axis, the lock surface being engageable with the projection to prevent movement of the plunger from the first position to the second position when the projection is engaged with the lock surface.

13. The dispensing valve of claim 12, wherein the open surface means includes an open surface, the open surface frictionally engageable with the projection to maintain the plunger in the second position when the projection is engaged with the open surface.

14. The dispensing valve of claim 13, wherein the open surface diverges from the body in a direction from the longitudinal axis at an angle greater than zero and less than 90 degrees, the open surface biasing the plunger toward the second position when the projection is engaged with the open surface.

15. The dispensing valve of claim 13, further comprising ramp surface means for permitting movement of the plunger from the second position to the first position wherein the projection slidably moves from engagement with the open surface to be in a position to engage the lock surface when opposing forces are applied to the plunger and the body in the direction of the longitudinal axis.

16. The dispensing valve of claim 15, wherein the body includes a grip extending from the body adapted to be engaged by a first external force applied in the direction of the longitudinal axis, and wherein the plunger includes a pad adapted to be engaged by a second external force opposing the first external force to move the plunger from the second position to the first position.

17. The dispensing valve of claim 12, wherein the arm includes release means for moving the projection away from the lock surface against the biasing means to permit movement of the plunger from the first position to the second position.

18. The dispensing valve of claim 17, wherein the release means includes a pad attached to the arm, the pad adapted to be engaged by an external force applied transversely to and toward the longitudinal axis wherein the projection moves away from the body as the force is applied.

19. The dispensing valve of claim 18, wherein the body includes a pad adapted to be engaged by a first axial external force applied to the body in a direction of the longitudinal axis, and wherein the pad attached to the arm of the plunger is further adapted to receive a second axial external force opposing the first external force applied to the pad of the body to move the plunger from the first position to the second position.

20. A two-piece valve comprising:

a body having a fluid passage through an interior of the body defining an inner surface connecting a first opening to a second opening, the inner surface including a first sealing surface between the first opening and the second opening, the fluid passage having a portion defining a longitudinal axis, the body further including an outer surface;

a plunger slidably positioned in the interior of the body for movement along the longitudinal axis, the plunger having a first sealing surface, the plunger positionable in a first position wherein the first sealing surface of the plunger and the first sealing surface of the body engage to form a fluid tight seal between the first opening and the second opening, the plunger positionable in a second position wherein fluid flow is permitted between the first opening and the second opening through the fluid passage;

a first arm extending from the plunger, the first arm including a projection slidably engageable with the outer surface of the body, the first arm including biasing means for biasing the projection against the outer surface of the body;

the outer surface of the body including a lock surface extending from the body transversely to the longitudinal axis and engageable with the projection when the plunger is in the first position for maintaining the plunger in the first position;

means attached to the first arm adapted to be engaged by an external force applied transversely to and toward the longitudinal axis for opposing the biasing means to move the projection away from the lock surface to permit movement of the plunger from the first position to the second position by the application of external opposing force applied to the body and to the plunger in the direction of the longitudinal axis;

the outer surface of the body further including an open surface frictionally engageable with the projection when the plunger is in the second position for maintaining the plunger in the second position; and means attached to the body for linking the lock surface to the open surface to permit sliding movement of the projection from the open surface to the lock surface to permit movement of the plunger from the second position to the first position by the application of external opposing forces applied to the body and to the plunger in the direction of the longitudinal axis.

21. The valve of claim 20, wherein the body further includes a plunger passage extending from a plunger opening to the interior of the body in fluid communication with the fluid passage, the plunger passage having a sealing surface, the plunger having a second sealing surface, the plunger being slidably received through the plunger opening into the plunger passage, the second sealing surface of the plunger and the sealing surface of the plunger passage engageable to form a fluid tight seal between the plunger opening and the fluid passage.

22. The valve of claim 21, wherein the second sealing surface of the plunger is formed on a resilient flexible projection extending from the plunger, and the sealing surface of the plunger passage engageable with the projection is a surface extending in a direction of the longitudinal axis.

23. The valve of claim 22, wherein the first sealing surface of the plunger is located on a tapered diameter portion of the plunger.

24. The valve of claim 21, further comprising stop means for preventing removal of the plunger from the plunger opening once received during assembly.

25. The valve of claim 24, wherein the stop means includes a stop surface extending from the body generally transversely to the longitudinal axis and engageable with the projection when the plunger is in the second position.

26. The valve of claim 25, further comprising a ramp surface on the body to engage the projection and move the projection against the biasing means during assembly to permit the projection to slide past the stop surface during the application of opposing forces applied to the body and to the plunger in the direction of the longitudinal axis.

27. The valve of claim 26, further comprising an alignment projection on the ramp surface of the body, and a notch on the projection of the arm for receiving the alignment projection on the body during assembly.

28. The valve of claim 20, further comprising fitment means for attaching to a container containing fluid.

29. The valve of claim 28, wherein the container includes a flexible bag attached to the fitment means, the bag being fillable with a liquid for dispensing through the valve.

30. The valve of claim 20, wherein the container includes a vented rigid container attached to the fitment means, the rigid container being fillable with a liquid for dispensing through the valve.

31. The valve of claim 20, further comprising a second arm extending from the plunger substantially similar to the first arm wherein the second arm is radially disposed on an opposite side of the plunger relative to the longitudinal axis.

32. The valve of claim 20, further comprising a male insert portion insertable into a female coupling member, the male insert member being formed on one end of the body and in fluid communication with the fluid passage through one of the first or second openings, the male insert portion including a partline free seal member, the male insert portion further including a groove member disposed between the seal member and the body, the groove adapted to receive the latch mechanism of the female coupling member.

33. The valve of claim 20, wherein the plunger and the body are made from resilient plastic.

34. A two-piece valve comprising:

a body having a fluid passage through an interior of the body defining an inner surface connecting a first opening to a second opening, the inner surface including a first sealing surface between the first opening and the second opening, the fluid passage having a portion defining a longitudinal axis, the body further having a plunger passage extending from a plunger opening to the interior of the body, the plunger passage in fluid communication with the fluid passage, the plunger passage having a sealing surface; and an integrally molded plastic plunger slidably positioned in the interior of the body for movement along the longitudinal axis, the plunger having a first annular sealing surface, the plunger positionable in a first position wherein the first annular sealing surface of the plunger and the first sealing surface of the body engage to form a fluid tight seal between the first opening and the second opening, the plunger positionable in a second position wherein fluid flow is permitted between the first opening and the second opening through the fluid passage, the plunger further having a second annular sealing surface, the plunger being slidably received through the plunger opening into the plunger passage, the second annular sealing surface of the plunger and the sealing surface of the plunger passage slidably engageable to form a fluid tight seal between the plunger opening the fluid passage;

the first annular sealing surface of the plunger being partline free;

the second annular sealing surface of the plunger being partline free and formed on a resilient flexible projection extending from the plunger.

35. A dispensing valve comprising:

a body defining a passage with a first opening and a second opening, the body further having an outer surface with a first surface portion and a second surface portion;

seal means including a plunger mounted for sliding movement in the passage of the body, the seal means forming a fluid tight seal in the passage between the first opening and the second opening in a first position, the seal means permitting fluid flow between the first opening and the second opening through the passage in a second position;

projection means connected to the seal means for selectively engaging the first surface portion and the second surface portion of the outer surface of the body, the projection means engaging the first surface portion to maintain the seal means in the first position, the projection means engaging the second surface portion to maintain the seal means in the second position; and biasing means for biasing the projection means into engagement with the first surface portion when the seal means is in the first position and for biasing the projection means into engagement with the second surface portion when the seal means is in the second position.

36. A dispensing valve comprising:

a body defining a passage with a first opening and a second opening, the body further having an outer surface with a first surface portion and a second surface portion;

seal means including a plunger mounted for sliding movement in the passage of the body, the seal means forming a fluid tight seal in the passage between the first opening and the second opening in a first position, the seal means permitting fluid flow between the first opening and the second opening through the passage in a second position; and projection means connected to the seal means for selectively engaging the first surface portion and the second surface portion of the outer surface of the body, the projection means engaging the first surface portion to maintain the seal means in the first position, the projection means engaging the second surface portion to maintain the seal means in the second position, wherein the projection means and the second surface portion frictionally engage when the seal means is in the second position to maintain the seal means in the second position.

* * * * *

UNITED STATES PATENT AND TRADEMARK OFFICE

CERTIFICATE OF CORRECTION

PATENT NO. : 5,178,303

DATED : January 12, 1993

INVENTOR(S) : Brian J. Blenkush et al.

It is certified that error appears in the above-indentified patent and that said Letters Patent is hereby corrected as shown below:

Column 14, line 47, Claim 34, insert --and-- after the word "opening".

Signed and Sealed this

Eighth Day of August, 1995

*Attest:*

*Attesting Officer*

Bruce Lehman

BRUCE LEHMAN

*Commissioner of Patents and Trademarks*